US009136584B2

(12) United States Patent
Wang

(10) Patent No.: US 9,136,584 B2
(45) Date of Patent: Sep. 15, 2015

(54) ANTENNA SYSTEM

(71) Applicant: Apple Inc., Cupertino, CA (US)

(72) Inventor: Shu-Li Wang, Stafford, TX (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/858,865

(22) Filed: Apr. 8, 2013

(65) Prior Publication Data

US 2013/0229322 A1 Sep. 5, 2013

Related U.S. Application Data

(60) Continuation of application No. 12/764,788, filed on Apr. 21, 2010, now Pat. No. 8,427,377, which is a division of application No. 11/486,223, filed on Jul. 12, 2006, now Pat. No. 7,773,041.

(51) Int. Cl.

| | |
|---|---|
| ***H01Q 1/24*** | (2006.01) |
| ***H01Q 1/22*** | (2006.01) |
| ***H01Q 1/38*** | (2006.01) |
| ***H01Q 7/00*** | (2006.01) |
| ***H01Q 9/26*** | (2006.01) |

(52) U.S. Cl.

CPC ..... *H01Q 1/22* (2013.01); *H01Q 1/243* (2013.01); *H01Q 1/38* (2013.01); *H01Q 7/00* (2013.01); *H01Q 9/265* (2013.01)

(58) Field of Classification Search

USPC ..... 343/702, 741, 742, 866, 867

See application file for complete search history.

(56) References Cited

U.S. PATENT DOCUMENTS

| | | | | |
|---|---|---|---|---|
| 2,942,263 | A | 6/1960 | Baldwin | |
| 3,394,373 | A | 7/1968 | Makrancy | |
| 4,445,123 | A | 4/1984 | Wright | |
| 4,879,755 | A | 11/1989 | Stolarczyk et al. | |
| 4,894,663 | A | 1/1990 | Urbish | |
| 4,980,694 | A | 12/1990 | Hines | |
| 5,021,010 | A | 6/1991 | Wright | |
| 5,041,838 | A | 8/1991 | Liimatainen | |
| 5,048,118 | A | 9/1991 | Brooks | |
| 5,061,943 | A | 10/1991 | Rammos | |
| 5,105,396 | A | 4/1992 | Ganter et al. | |
| 5,113,196 | A | 5/1992 | Ponce de Leon | |
| 5,227,805 | A | 7/1993 | King et al. | |
| 5,381,387 | A | 1/1995 | Blonder et al. | |
| 5,408,241 | A | 4/1995 | Shattuck | |
| 5,408,699 | A * | 4/1995 | Yamashita et al. | 455/274 |
| 5,469,178 | A | 11/1995 | Nguyen et al. | |

(Continued)

FOREIGN PATENT DOCUMENTS

| | | |
|---|---|---|
| EP | 1286413 | 2/2003 |
| EP | 1315238 | 12/2003 |

(Continued)

OTHER PUBLICATIONS

Pascolini et al., U.S. Appl. No. 13/620,188, filed Sep. 14, 2012.

(Continued)

*Primary Examiner* — Tan Ho

(74) *Attorney, Agent, or Firm* — Michael H. Lyons

(57) ABSTRACT

An antenna system includes a dielectrically-loaded loop element electromagnetically coupled to a planar element. The antenna system exhibits uniform, broadband radiation and reception patterns.

18 Claims, 12 Drawing Sheets

(56) References Cited

U.S. PATENT DOCUMENTS

| | | | | |
|---|---|---|---|---|
| 5,473,252 | A | 12/1995 | Renz et al. | |
| 5,561,437 | A | 10/1996 | Phillips | |
| 5,754,143 | A | 5/1998 | Warnagiris | |
| 5,798,984 | A | 8/1998 | Koch | |
| 6,011,519 | A * | 1/2000 | Sadler et al. | 343/742 |
| 6,011,699 | A | 1/2000 | Murray | |
| 6,097,345 | A | 8/2000 | Walton | |
| 6,121,935 | A | 9/2000 | Reece et al. | |
| 6,269,054 | B1 | 7/2001 | Truini | |
| 6,282,433 | B1 | 8/2001 | Holshouser | |
| 6,337,662 | B1 | 1/2002 | Cassel | |
| 6,400,321 | B1 | 6/2002 | Fenwick et al. | |
| 6,603,430 | B1 | 8/2003 | Hill et al. | |
| 6,622,031 | B1 | 9/2003 | McCleary | |
| 6,646,610 | B2 * | 11/2003 | Troelsen | 343/702 |
| 6,670,923 | B1 | 12/2003 | Kadambi et al. | |
| 6,697,025 | B2 | 2/2004 | Koyanagi et al. | |
| 6,741,214 | B1 | 5/2004 | Kadambi et al. | |
| 6,747,601 | B2 | 6/2004 | Boyle | |
| 6,762,723 | B2 | 7/2004 | Nallo | |
| 6,812,902 | B2 | 11/2004 | Rossman et al. | |
| 6,853,605 | B2 | 2/2005 | Fujisawa et al. | |
| 6,856,294 | B2 | 2/2005 | Kadambi et al. | |
| 6,867,738 | B2 | 3/2005 | Birnbaum et al. | |
| 6,909,401 | B2 | 6/2005 | Rutfors et al. | |
| 6,924,773 | B1 | 8/2005 | Paratte | |
| 6,968,508 | B2 | 11/2005 | Lucaci | |
| 6,980,154 | B2 | 12/2005 | Vance et al. | |
| 7,027,838 | B2 | 4/2006 | Zhou et al. | |
| 7,035,170 | B2 | 4/2006 | Narayanaswami et al. | |
| 7,113,143 | B2 * | 9/2006 | Minemura | 343/870 |
| 7,119,747 | B2 | 10/2006 | Lin et al. | |
| 7,123,208 | B2 | 10/2006 | Baliarda et al. | |
| 7,215,600 | B1 | 5/2007 | DeRosa | |
| 7,551,142 | B1 | 6/2009 | Zhang et al. | |
| 7,595,759 | B2 | 9/2009 | Schlub et al. | |
| 7,612,725 | B2 | 11/2009 | Hill et al. | |
| 7,627,349 | B2 | 12/2009 | Vetelainen et al. | |
| 7,714,790 | B1 | 5/2010 | Feldstein et al. | |
| 7,768,462 | B2 | 8/2010 | Zhang et al. | |
| 7,773,041 | B2 | 8/2010 | Wang | |
| 7,889,139 | B2 | 2/2011 | Hobson et al. | |
| 2001/0043514 | A1 | 11/2001 | Kita | |
| 2002/0126236 | A1 | 9/2002 | Hiratsuka | |
| 2003/0107518 | A1 | 6/2003 | Li et al. | |
| 2004/0017318 | A1 | 1/2004 | Annabi | |
| 2004/0090377 | A1 | 5/2004 | Dai et al. | |
| 2004/0145521 | A1 | 7/2004 | Hebron et al. | |
| 2004/0257283 | A1 | 12/2004 | Asano et al. | |
| 2006/0055606 | A1 | 3/2006 | Boyle | |
| 2006/0097941 | A1 | 5/2006 | Bettner et al. | |
| 2006/0125703 | A1 | 6/2006 | Ma et al. | |
| 2007/0176843 | A1 | 8/2007 | Qureshi | |
| 2007/0182658 | A1 | 8/2007 | Ozden | |
| 2008/0143613 | A1 | 6/2008 | Iwai et al. | |
| 2009/0153407 | A1 | 6/2009 | Zhang et al. | |
| 2009/0197654 | A1 * | 8/2009 | Teshima et al. | 455/575.7 |
| 2009/0256758 | A1 | 10/2009 | Schlub et al. | |
| 2010/0123632 | A1 | 5/2010 | Hill et al. | |
| 2011/0006953 | A1 | 1/2011 | Chiang et al. | |

FOREIGN PATENT DOCUMENTS

| | | |
|---|---|---|
| EP | 1401050 | 3/2004 |
| WO | 02078123 | 10/2002 |
| WO | 04001894 | 12/2003 |
| WO | 2005032130 | 4/2005 |
| WO | 2005109567 | 11/2005 |
| WO | 2006114771 | 11/2006 |
| WO | 2007039668 | 4/2007 |

OTHER PUBLICATIONS

H. Nakano et al., "Low-Profile Inverted-F Antenna with Parasitic Elements on an Infinite Ground Plane," IEE Proceedings online No. 19982067, IEE Proc.-Microw. Antennas Propag., vol. 145, No. 4, Aug. 1998, pp. 321-325.

Constantine A. Balanis, "Linear Elements Near or on Infinite Perfect Conductors," Antenna Theory, 3rd Ed. Copyright 2005, Published by John Wiley & Sons, Hoboken, New Jersey, pp. 184-187, complete reference total pp. 12.

Hishashi Moroshita et al., "A Balance-Fed Loop Antenna System for Handset," PAPER: Special Section on Multi-Dimensional Mobile Information Networks, IEICE Trans. Fundamental, vol. E82-A, No. 7, Jul. 1999, pp. 1138-1143.

* cited by examiner

ANTENNA SYSTEM

This application is a continuation of patent application Ser. No. 12/764,788, filed Apr. 21, 2010, which is a division of patent application Ser. No. 11/486,223, filed Jul. 12, 2006, now U.S. Pat. No. 7,773,041, which are hereby incorporated by reference herein in their entireties.

FIELD OF THE INVENTION

The invention relates to antenna systems and, in particular, to antenna systems for wireless communication devices.

BACKGROUND OF THE INVENTION

Advances in semiconductor technology have allowed wireless communication devices, such as cell phones, personal digital assistants (PDA's) and pagers, to become smaller and smaller. However, the antenna systems for these devices have not evolved at the same pace because antenna efficiency generally decreases with reductions in antenna size. To maintain reasonable gain and non-directional receive/transmit patterns, most conventional antenna designs have relied on external monopole antennas, either fixed or telescoping. Other designs have realized internal antennas of different varieties (e.g., monopole, dipole, helical and patch antennas). However, these antennas are susceptible to performance degradation due to the proximity of other components. For example, coupling to the electric fields of internal components (e.g. oscillators, amplifiers, mixers) can degrade the signal-to-noise ratio of the receiving section of the wireless device, and internal ground planes and metallic enclosures can distort antennas patterns or completely block transmission and reception in some directions. Therefore, in order to obtain reasonable antenna performance, these internal antennas are normally kept away from other components in the wireless device by placing them in separate areas, adding size and volume to the wireless devices.

SUMMARY OF THE DESCRIPTION

Various embodiments of an antenna system are described. In one exemplary embodiment, an antenna system includes a dielectrically-loaded loop element and a substantially planar element. The substantially planar element is disposed substantially parallel to a major axis of the dielectrically-loaded loop element, substantially perpendicular to a minor axis of the dielectrically-loaded loop element and within an induction field region of the dielectrically-loaded loop element. Features and benefits of the various embodiments of the invention will be apparent from the description.

At least certain embodiments of the present invention include a portable device having an antenna structure therein, the antenna structure including a generally U-shaped loop element coupled with a support element having a substantially planar portion, wherein the substantially planar portion has an electrical length along a first dimension proximate to one wavelength of a frequency of interest, and an electrical length along a second dimension proximate to one-half wavelength of the frequency of interest, where the support element is located within an induction field of the loop element.

At least certain embodiments of the present invention include an embodiment of the antenna system as part of a digital media player, such as a portable music and/or video media player, which includes a media processing system to present the media, a storage device to store the media and a radio frequency (RF) transceiver to couple the antenna system to the media processing system. The RF transceiver uses the antenna system to transmit or receive the media, which may be one or more of music, still pictures or motion pictures, for example. The portable media player may include a media selection device, such as a click wheel device, a touchpad, pushbuttons or other similar selection devices as are known in the art. The media selection device may be used to select the media stored on the storage device. The portable media player may, at least in certain embodiments, include a display device, such as an LCD display, coupled to the media processing system to display titles or other indicators of media selected with the input device and presented, through a speaker and/or earphones or on the display device or on both the display and a speaker and/or earphones. In certain embodiments, the display device may also be the media selection device such as, for example, an LCD touch screen device.

At least certain embodiments of the present inventions include an embodiment of the antenna system as part of a wireless device such as a cellular telephone, smart phone or personal digital assistant, for example, which includes a digital radio frequency (RF) transceiver. The digital RF transceiver uses the antenna system to send and receive digital voice and/or data signals. The wireless device may include a digital processing system coupled to the transceiver to control the transceiver and manage the digital signals. The digital processing system may be coupled to a storage device to store data, to a display device such as an LCD display to display data and/or receive user input (e.g., via touch screen sensors), to an input device such as a keypad, and to audio transducers (e.g., microphone and/or speaker) with associated analog/digital converters and device drivers.

BRIEF DESCRIPTION OF THE DRAWINGS

Embodiments of the present invention are illustrated by way of example and not limitation in the figures of the accompanying drawings in which like references indicate similar elements.

DETAILED DESCRIPTION

Figure 1A:
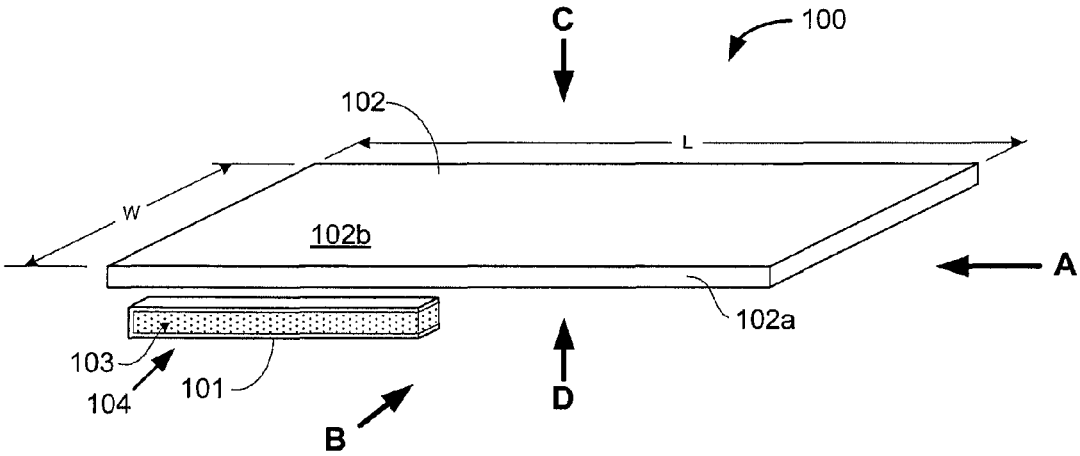
FIG. 1A illustrates an antenna system in one embodiment.

Various embodiments and aspects of the invention will be described with reference to details discussed below, and the accompanying drawings will illustrate the various embodiments. The following description and drawings are illustrative of the invention and are not to be construed as limiting the invention. Numerous specific details such as dimensions and frequencies are described to provide a thorough understanding of various embodiments of the present invention. However, in certain instances, well-known or conventional details are not described in order to not unnecessarily obscure the embodiments of the present invention.

At least certain embodiments of the present invention include a portable device having an antenna structure therein, the antenna structure including a generally U-shaped loop element coupled with a support element having a substantially planar portion, wherein the substantially planar portion has an electrical length along a first dimension proximate to one wavelength of a frequency of interest, and an electrical length along a second dimension proximate to one-half wavelength of the frequency of interest, where the support element is located within an induction field of the loop element.

At least certain embodiments of the antenna system described herein may be part of a digital media player, such as a portable music and/or video media player, which includes a media processing system to present the media, a storage device to store the media and a radio frequency (RF) transceiver coupled with the antenna system and the media processing system. In certain embodiments, media stored on a remote storage device may be transmitted to the media player. The media player may receive the transmitted media via the antenna system and RF transceiver, and may store and/or stream the media. In other embodiments, the media player may transmit the media to a remote storage device and/or another media player. The media may be, for example, one or more of music or other audio, still pictures, or motion pictures. The portable media player may include a media selection device, such as a click wheel device on an iPod® or iPod Nano® media player from Apple Computer, Inc. of Cupertino, Calif., a touch screen device, pushbutton device, movable pointing device or other selection device. The media selection device may be used to select the media stored on the storage device and/or the remote storage device. The portable media player may, in at least certain embodiments, include a display device which is coupled to the media processing system to display titles or other indicators of media being selected through the input device and being presented, either through a speaker or earphone(s), or on the display device, or on both the display device and a speaker or earphone(s). In certain embodiments, the display device may also be the media selection device (e.g., a touch screen display device). Examples of a portable media player are described in published U.S. Patent Applications 2003/0095096 and 2004/0224638, both of which are incorporated herein by reference.

Figure 1B:
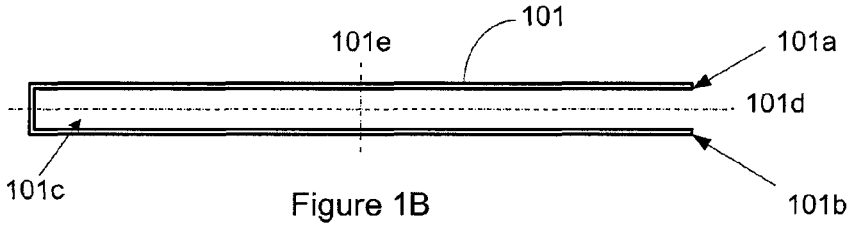
FIG. 1B illustrates a loop element of an antenna assembly in one embodiment.

FIG. 1A illustrates an antenna system 100 according to one embodiment of the invention. In FIG. 1A, a generally U-shaped dielectrically-loaded loop element 104 includes a loop element 101 loaded with a dielectric material 103. Dielectrically-loaded loop element 104 is located in proximity to an element with a substantially planar portion 102 (referred to as "planar element" hereinafter for convenience), having a substantially rectangular footprint. As illustrated in FIG. 1B, the loop element 101 has terminals 101*a* and 101*b* (driven end of the loop), an aperture 101*c*, a major axis 101*d* and a minor axis 101*e*. Loop element 101 may be, for example, a metallic ribbon or tape, as illustrated in FIG. 1A. Alternatively, loop element 101 may be a wire element, a printed circuit element or any combination thereof. Dielectric material 103 may be any low loss dielectric material such as epoxy-fiberglass printed-circuit board material, poly-tetrafluoroethylene (PTFE) fiberglass or the like. Dielectrically-loaded loop element 104 may have a total electrical length between approximately one-half wavelength and one wavelength at a center frequency of the antenna system.

Figure 1C:
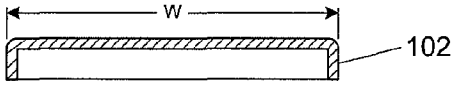
FIG. 1C illustrates a cross-section of a planar antenna element in one embodiment.
Figure 1D:
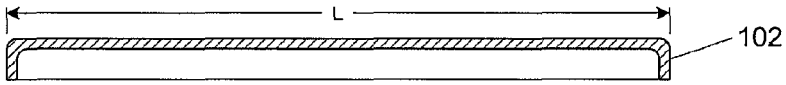
FIG. 1D illustrates another cross-section of a planar antenna element in one embodiment.

Planar element 102 may have a width W and a length L. As illustrated in FIGS. 1C and 1D, the "planar element" 102 may have a shape more complex than a simple plane. For example, planar element 102 may have a flanged edge or a curved portion and/or section in addition to a planar portion, and may still be considered substantially planar. For example, planar element 102 may be part of a case assembly (e.g., a backplate) of a wireless communications device (e.g., a cellular phone, smart phone, PDA and the like) or a media player. Planar element 102 may be, for example, a metal-plated insulator or dielectric material such as molded plastic or the like. Alternatively, planar element 102 may be a fabricated, cast or formed piece of metal. In one embodiment, as illustrated in FIG. 1A, a face 102*b* of planar element 102 may be disposed substantially parallel to the major axis 101*d* of the aperture 101*c*, and substantially perpendicular the minor axis 101*e* of loop element 101. In one embodiment, the major axis 101*d* of loop element 101 may be disposed substantially parallel to an edge 102*a* of the planar element 102. In other embodiments, the dielectrically-loaded loop element 104 may be located at any location and at any orientation with respect to the planar element 102, provided that minor axis 101*e* is substantially perpendicular to planar element 102 and major axis 101*d* is substantially parallel to planar element 102. The distance between dielectrically-loaded loop element 104 and planar element 102 may be adjusted to tune the input impedance of dielectrically-loaded loop element 104. In one embodiment, dielectrically-loaded loop element 104 may be separated from planar element 102 by less than or equal to one-fortieth of a free-space wavelength at an operating frequency of the antenna system 100.

Figure 2:
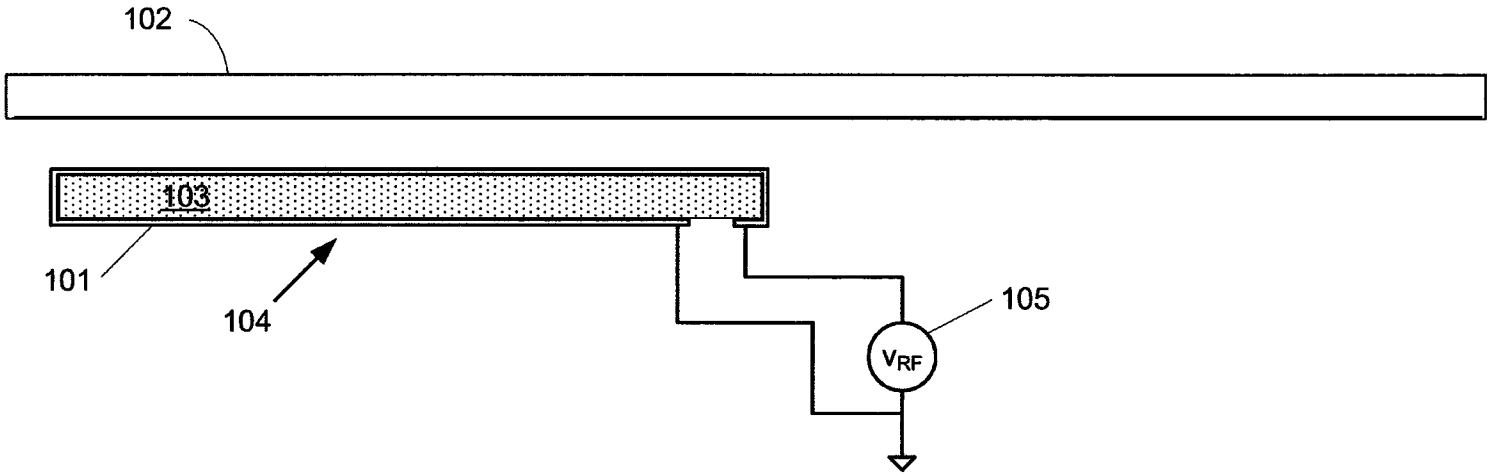
FIG. 2 illustrates a plane view of the antenna system embodiment of FIG. 1A.

FIG. 2 illustrates a plane view of antenna system 100 in one embodiment. In FIG. 2, dielectrically-loaded loop element 104 is formed by wrapping loop element 101 around the dielectric material 103 such that the terminals 101*a* and 101*b* of loop element 101 are co-planar on one surface of dielectric material 103. The terminals 101*a* and 101*b* may be driven by an RF (radio frequency) voltage source, illustrated schematically as RF voltage source 105. In one embodiment illustrated, dielectric material 103 may be a printed circuit board (PCB) assembly and RF voltage source 105 may be a PCB-mounted RF voltage source.

Figure 3:
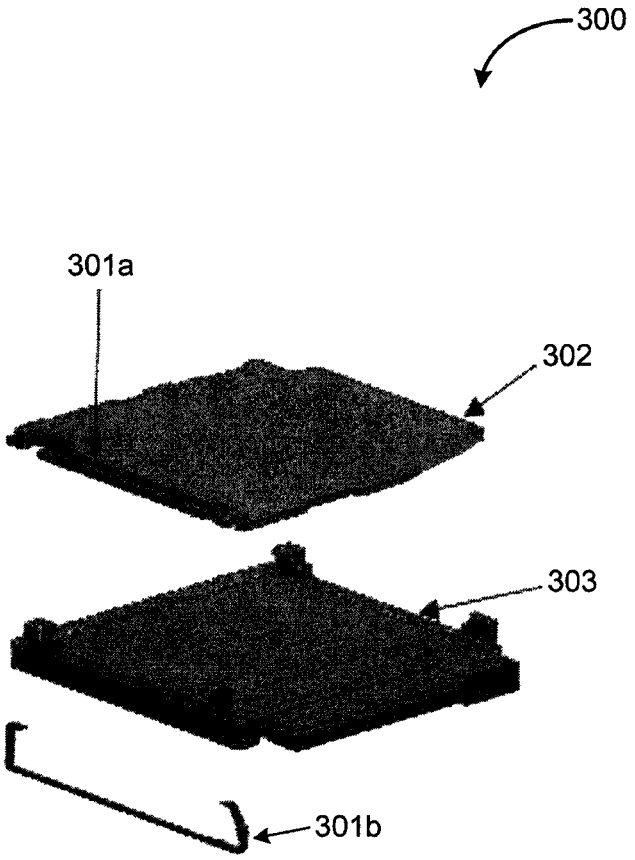
FIG. 3 is an exploded view illustrating a dielectrically-loaded loop element in one embodiment.

In one embodiment, as illustrated in FIG. 3, a dielectrically-loaded loop element, such as dielectrically-loaded loop element 101, may be integrated into the assembly of an electronic device such as a communications device or media player, for example, such that planar element 102 serves as a physical support element for dielectrically-loaded loop element 101. FIG. 3 is an exploded view 300 of an exemplary assembly of a printed circuit board (PCB) and an LCD display. In FIG. 3, a first section of a dielectrically-loaded loop element may be embodied as a printed trace 301*a* on a PCB 302. A second section of a dielectrically-loaded loop element may be embodied as a printed trace on a flexible circuit 301*b*. PCB 302 may then be loaded with PCB mounted components such as LCD display 303, and the second section of the dielectrically-loaded loop element 301*b* may be formed around the PCB/LCD assembly and may be soldered or otherwise bonded with section 301*a* to form the loop element, wherein the loop element is integrated with the PCB assembly. The trace on the flex circuit may have a gap in an appropriate location (not shown) to provide terminal connections for the driven end of the loop as described above. The PCB assembly may then be mounted within the planar element 102 as illustrated in FIG. 5 and described below.

Figure 15:
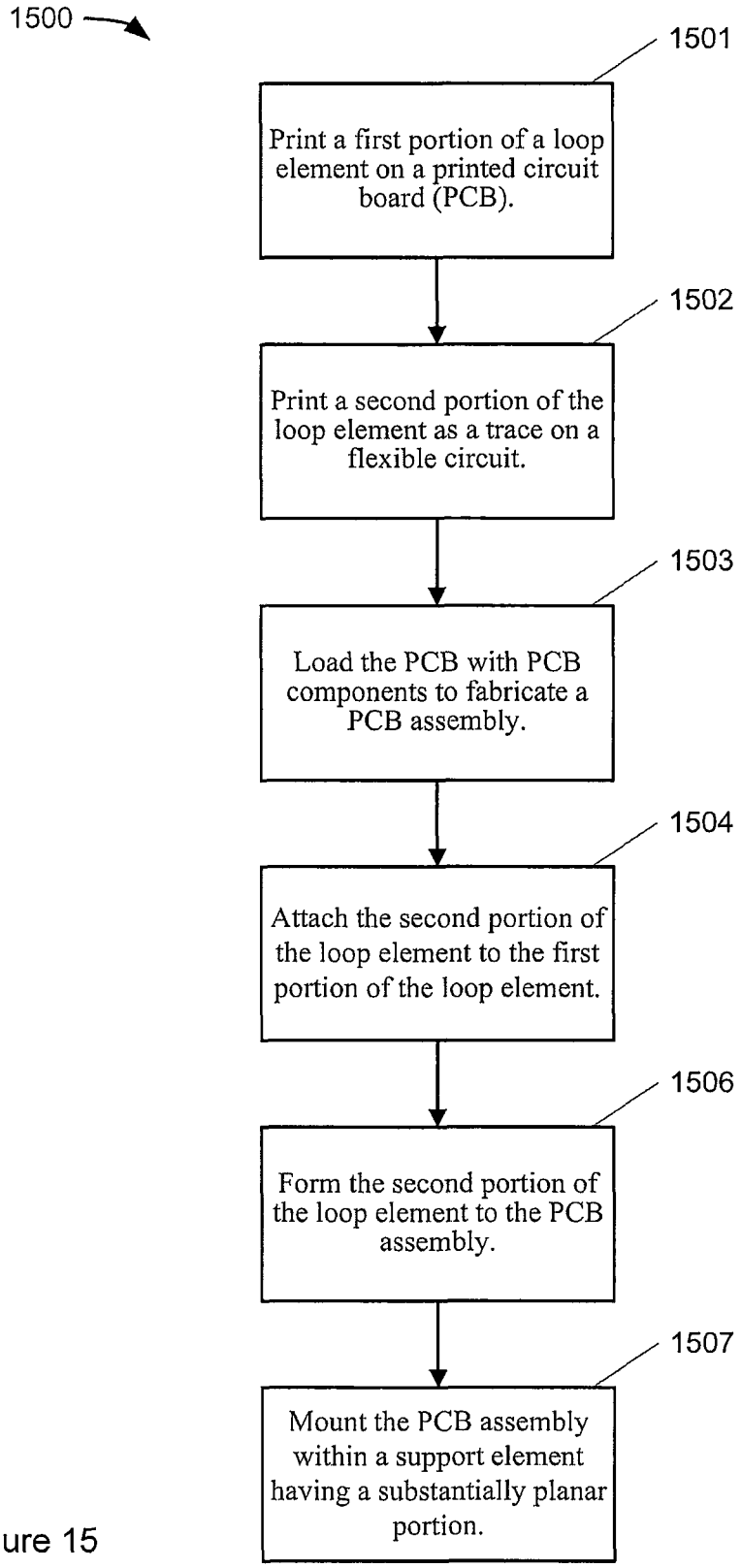
FIG. 15 is a flowchart illustrating a method of manufacture in one embodiment.

FIG. 15 is a flowchart illustrating a method 1500 for manufacturing the antenna system described herein in one embodiment. In operation 1501, a first portion of a loop element is printed on a printed circuit board (PCB). In operation 1502, a second portion of the loop element is printed as a trace on a flexible circuit. In operation 1503, the PCB is loaded with PCB components to fabricate a PCB assembly. In operation 1504, the second portion of the loop element is attached to the first portion of the loop element. In operation 1505, the second portion of the loop is formed to the PCB assembly, wherein the loop element is formed and integrated with the PCB assembly. In operation 1506, the PCB assembly is mounted within a support element having a substantially planar portion.

Figure 4:
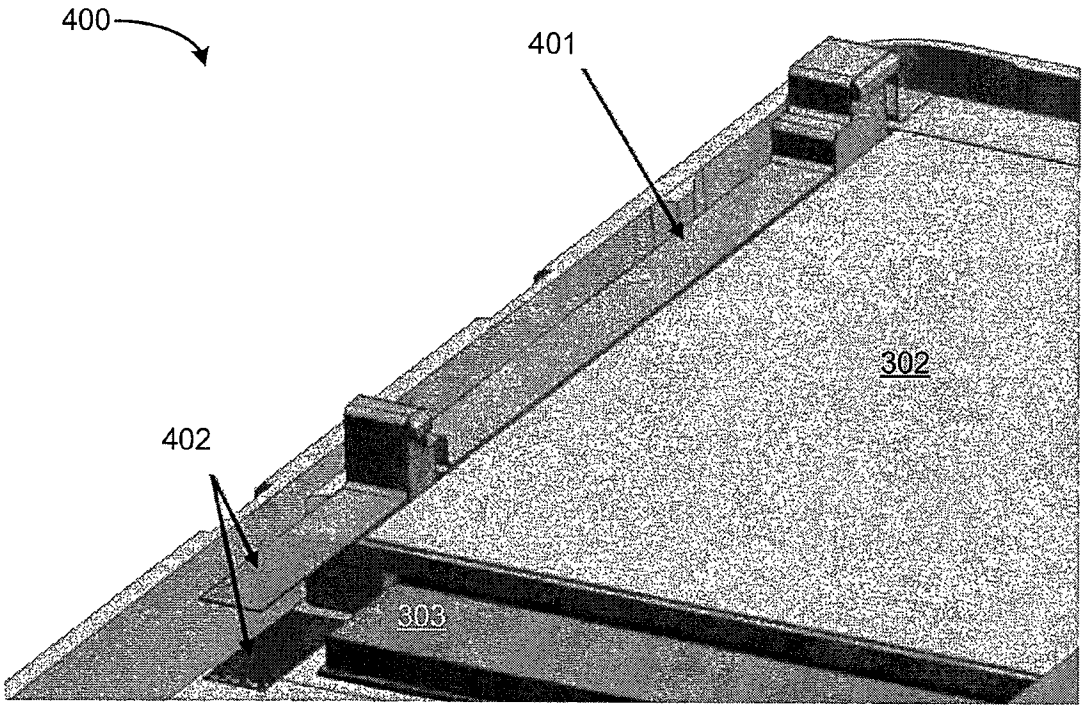
FIG. 4 is a partially assembled antenna system illustrating a dielectrically-load loop element in one embodiment.

FIG. 4 illustrates an alternative embodiment 400 of a dielectrically-loaded loop element. In FIG. 4, a single long piece of flex circuit 401 may be wrapped around and conformed to PCB 302 and/or LCD 303, with loop terminals 402 exposed as the driven end of the loop. A dielectrically-loaded loop element may be formed in a variety of different ways including (but not limited to) forming a loop by printing traces on both sides of a PCB and connecting the traces with wrap-around connections or plated feedthroughs.

Figure 5:
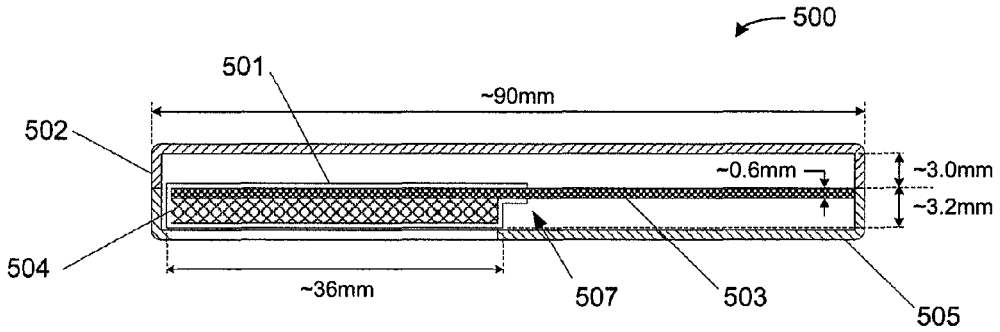
FIG. 5 is a cross-sectional view illustrating an antenna system in a wireless communications device in one embodiment.

FIG. 5 illustrates a cross-sectional view 500 of one exemplary embodiment of an antenna system in a wireless communications device, where the antenna system is configured to transmit and receive RF signals in a bandwidth around 2.4 GHz. In FIG. 5, a dielectrically-loaded loop element 501 is wrapped around a PCB 503 and an LCD display 504, as described above. Backplate 502 functions as a planar element as described above. A plastic cover 505 completes the assembly. For clarity of illustration, other components which may be present in a wireless communications device (e.g., a radio frequency transceiver, a digital processing system, a storage device and a battery) are not shown.

Figure 6A:
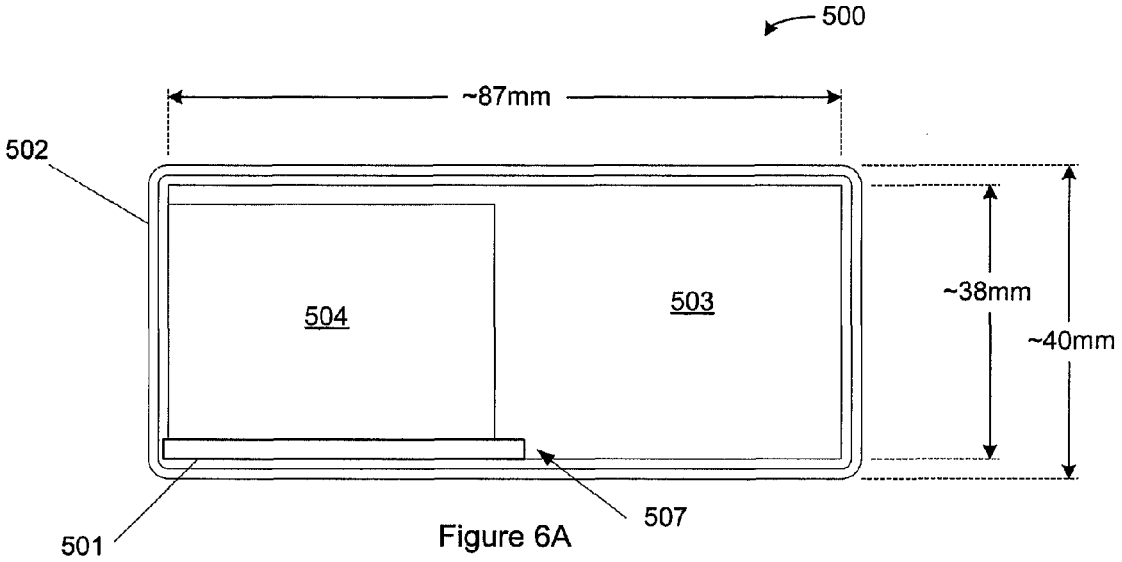
FIG. 6A is a plane view of the embodiment of FIG. 5.
Figure 6B:
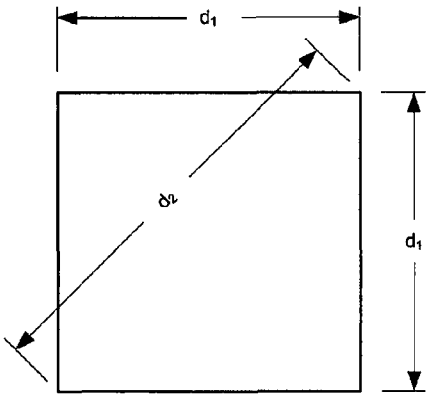
FIGS. 6B through 6E illustrate alternative embodiments of the invention.
Figure 6C:
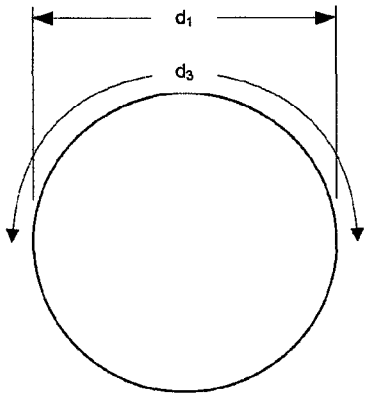
Figure 6E:
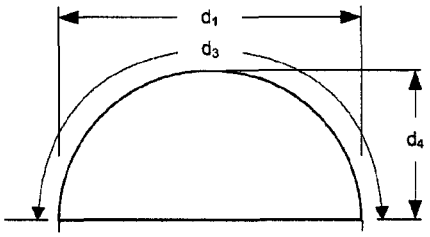
Figure 6D:
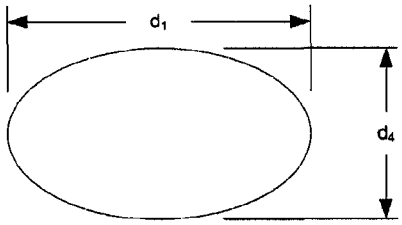

FIG. 6A illustrates another view of device 500, rotated 90 degrees and with plastic cover 505 removed. In the embodiment illustrated in FIGS. 5 and 6, dielectrically-loaded loop element 501 includes an aperture of approximately 36 millimeters (mm) by 3.2 mm and backplate 502 has a footprint of approximately 90 mm by 40 mm. PCB 503 has a footprint of approximately 87 mm by 38 mm and a thickness of 0.6 mm. PCB 503 may be fabricated from G10/FR-4 fiberglass epoxy laminate material conforming to Mil-I-24768/2 and/or Mil-24768/27, for example. Plastic cover 505 may be any plastic housing material as is normally used in portable electronic devices (e.g., ABS, polycarbonate, polystyrene or the like).

Each of PCB 503, LCD 504 and plastic cover 505 may be characterized by a dielectric constant that, as is known in the art, reduces the propagation velocity of electromagnetic energy and increases the electrical length (in contrast to the physical length) of those materials and surrounding structures which are electromagnetically coupled with the dielectric materials. For the configuration illustrated in FIGS. 5 and 6A, it has been determined experimentally that the electrical length of the long dimension of backplate 502 (i.e., approximately 90 mm) is approximately one-wavelength at approximately 2.4 GHz and the electrical length of the short dimension of backplate 502 (i.e., approximately 40 mm) is approximately one-half wavelength at approximately 2.4 GHz. It will be appreciated that device 500 is an exemplary embodiment, and that the dimensions of device 500 may be scaled to achieve comparable electrical lengths at other frequencies of interest.

Exemplary embodiment 500 is illustrated in FIG. 6A with a substantially rectangular footprint. Other embodiments of the invention, as illustrated in FIGS. 6B through 6E, for example, may have other footprints, such as a substantially square footprint (FIG. 6B), a substantially circular footprint (FIG. 6C), a substantially elliptical footprint (FIG. 6D), a substantially semi-circular footprint (FIG. 6E) or combinations thereof having principle dimensions (e.g., perimeters, diameters, diagonals, etc.) compatible with half-wave and full-wave resonant modes at a frequency of interest. For example, in FIGS. 6B through 6E, principle dimensions d1, d2, d3 or d4 may be approximately a half wavelength at a frequency of interest in various alternative embodiments. In yet other embodiments, principle dimensions d1, d2, d3 or d4 may be approximately one wavelength at a frequency of interest.

Figure 7:
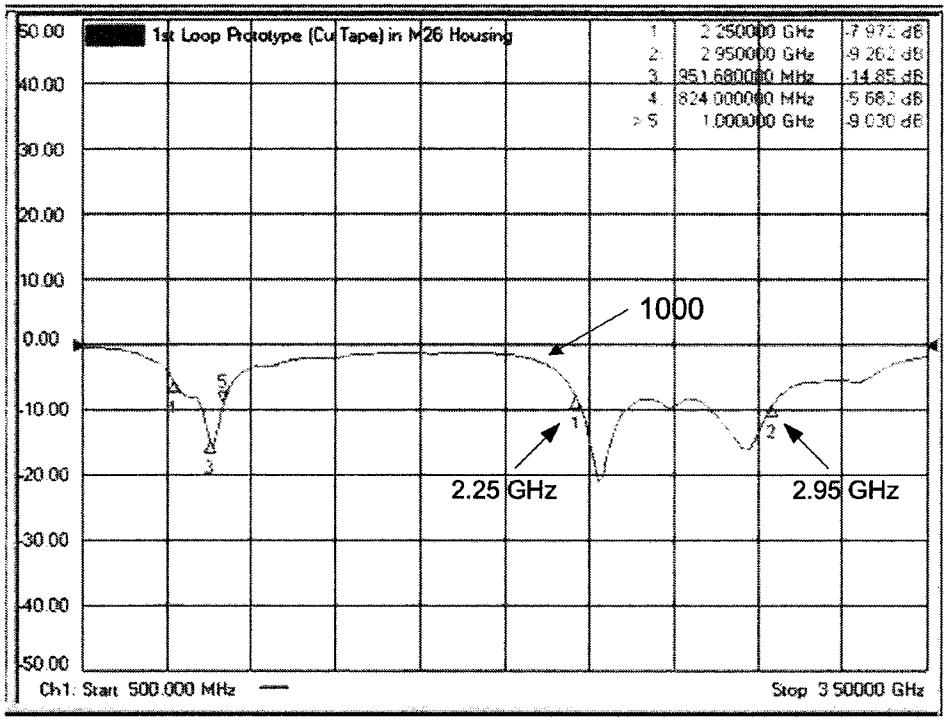
FIG. 7 is a graph illustrating an exemplary return loss of an antenna system in one embodiment.

FIG. 7 is a plot 1000 of return loss versus frequency at the driven end 507 of dielectrically-loaded loop element 501 in device 500. As is known in the art, return loss is a direct measure of the impedance match at the input of a circuit, and is an indirect measure of the efficiency of an antenna system. As shown by plot 1000, the return loss is greater than or equal to approximately 8 decibels (dB) from 2.25 GHz to 2.95 GHz, which represents approximately 85% efficiency (ignoring resistive losses) over a 13.5% bandwidth.

Figure 8B:
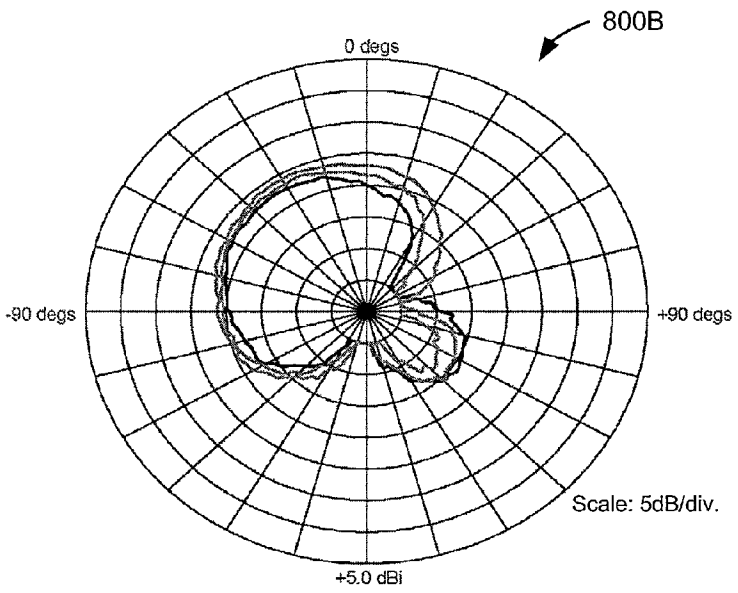
FIG. 8B is a gain plot illustrating a vertically polarized azimuth radiation pattern of an antenna system in one embodiment.
Figure 8A:
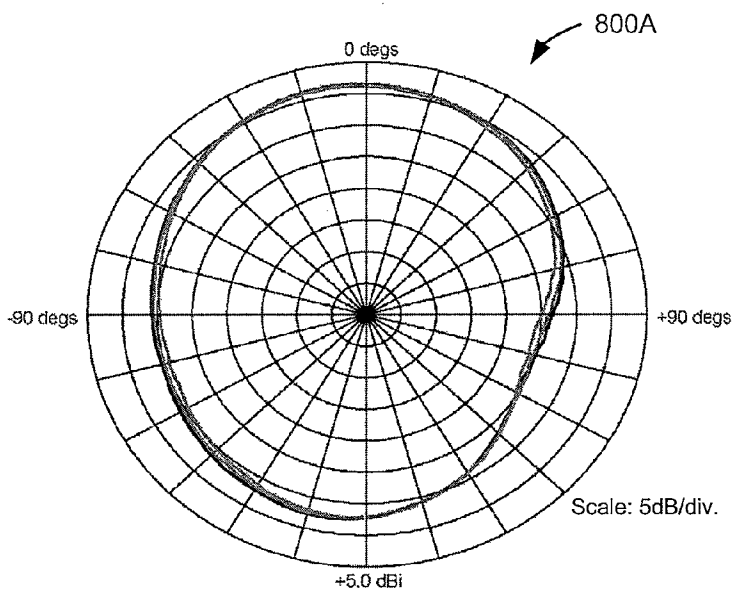
FIG. 8A is a gain plot illustrating a horizontally polarized azimuth radiation pattern of an antenna system in one embodiment.
Figure 9:
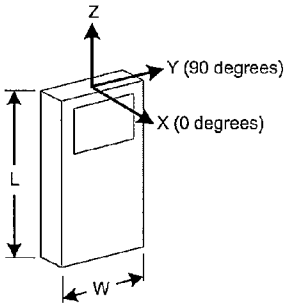
FIG. 9 illustrates an orientation of a wireless communications device for the azimuth (X-Y plane) radiation patterns of FIGS. 8A and 8B.

FIG. 8A is a horizontally polarized azimuth (X-Y plane) antenna pattern 800A of device 500 for the orientation illustrated in FIG. 9. Antenna pattern 800A includes superimposed patterns at 2.400 GHz, 2.440 GHz and 2.485 GHz, having average gains of −2.5 dBi (dB relative to an isotropic radiator), −2.6 dBi and −3.0 dBi, respectively.

FIG. 8B is a vertically polarized (cross-polarized) azimuth (X-Y plane) antenna pattern 800A of device 500 for the orientation illustrated in FIG. 9. Antenna pattern 800B includes superimposed patterns at 2.400 GHz, 2.440 GHz and 2.485 GHz.

Figure 10B:
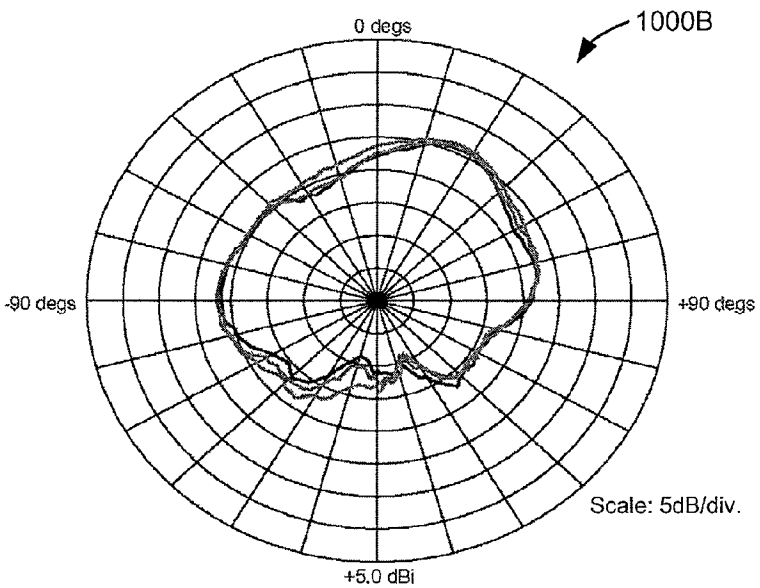
FIG. 10B is a gain plot illustrating a horizontally polarized elevation radiation pattern of an antenna system in one embodiment.
Figure 10A:
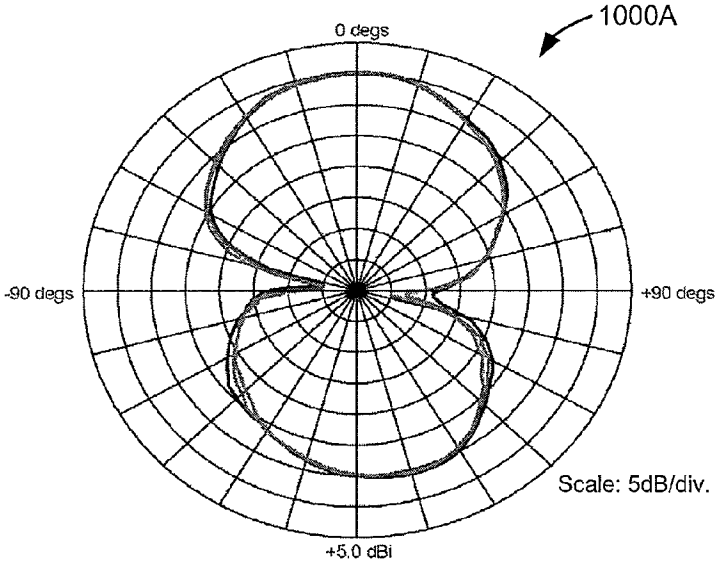
FIG. 10A is a gain plot illustrating a vertically polarized elevation radiation pattern of an antenna system in one embodiment.
Figure 11:
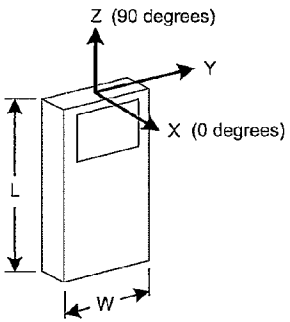
FIG. 11 illustrates an orientation of a wireless communications device for the elevation (X-Z plane) radiation patterns of FIGS. 10A and 10B.

FIG. 10A is a vertically polarized (co-polarized) elevation (X-Z plane) antenna pattern 1000A of device 500 for the orientation illustrated in FIG. 11. Antenna pattern 1000A includes superimposed patterns at 2.4 GHz, 2.44 GHz and 2.485 GHz, having peak gains of approximately 0 dBi at zero degrees and 180 degrees and 3 dB (half-power) beamwidths of approximately 60 degrees.

FIG. 10B is a horizontally polarized elevation (X-Z plane) antenna pattern 1000B of device 500 for the orientation illustrated in FIG. 11. Antenna pattern 1000A includes superimposed patterns at 2.4 GHz, 2.44 GHz and 2.485 GHz.

Figure 12:
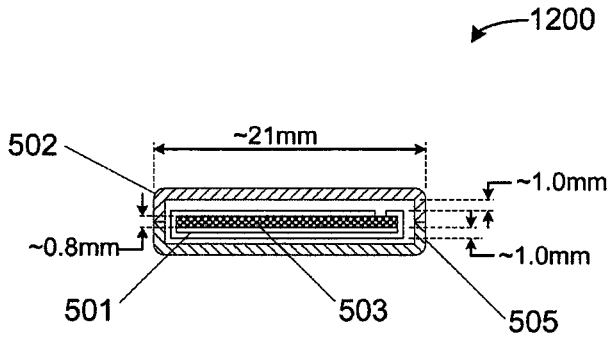
FIG. 12 is a cross-sectional view illustrating another embodiment of an antenna system in a wireless communications device.
Figure 13:
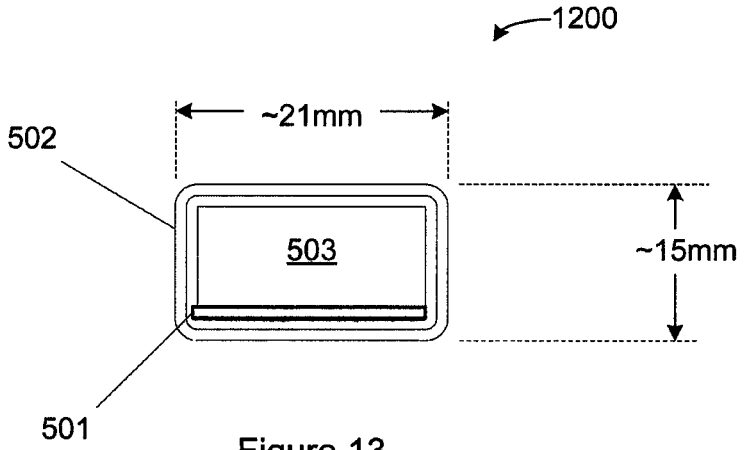
FIG. 13 is a plane view of the embodiment of FIG. 12.

FIGS. 12 and 13 illustrate one embodiment of an antenna system in a wireless communication device 1200. Device 1200 may include a dielectrically-loaded loop element 501, a PCB 503, a backplate 502 and a plastic cover 505 as previously described. As noted above, the device 1300 may be dimensionally scaled to achieve antenna resonance at other frequencies of interest.

Figure 14:
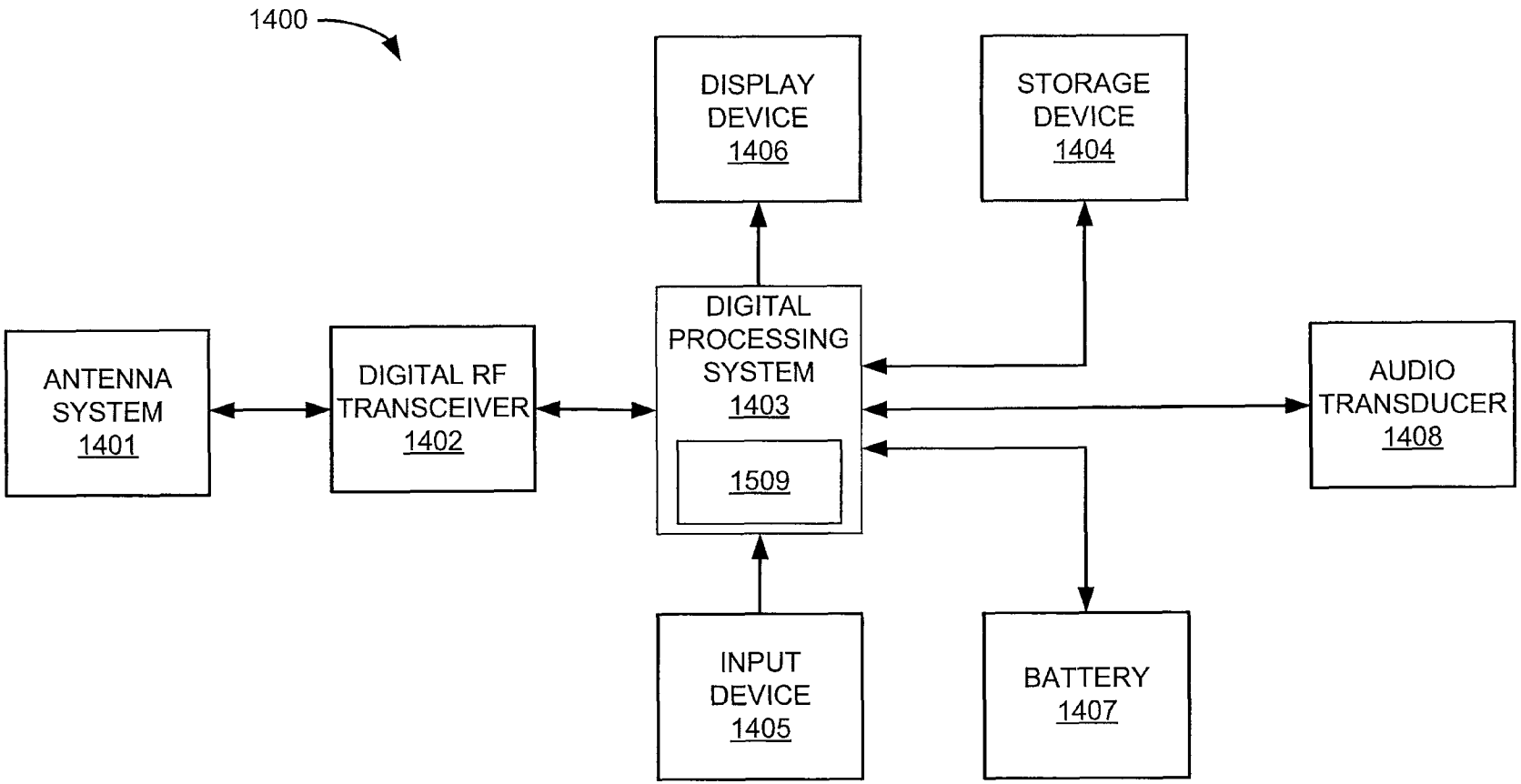
FIG. 14 is a block diagram illustrating a system in which embodiments of the invention may be implemented.

FIG. 14 is a block diagram illustrating a wireless device 1400, as described above, in which embodiments of the antenna system described herein may be implemented. Wireless device 1500 may be, for example, a portable media player, a cellular telephone, a smart phone, a personal digital assistant (PDA) or other portable wireless device. Wireless device 1400 may include an antenna system 1401, which may be antenna system 500 or 1200, for example. Wireless device 1400 may also include a digital radio frequency (RF) transceiver 1402, coupled to the antenna system 1401, to transmit and/or receive digital voice, data and/or media signals through antenna system 1401. Wireless device 1400 may also include a digital processing system 1403 to control the digital RF transceiver and to manage the digital voice, data and/or media signals. Digital processing system 1403 may be a general purpose processing device, such as a microprocessor or controller for example. Digital processing system 1403 may also be a special purpose processing device, such as an ASIC (application specific integrated circuit), FPGA (field-programmable gate array) or DSP (digital signal processor). Digital processing system 1403 may also include other devices, as are known in the art, to interface with other components of wireless device 1400. For example, digital processing system 1403 may include analog-to-digital and digital-to-analog converters to interface with other components of wireless device 1400 as described below. Digital processing system 1403 may include a media processing system 1409, which may also include a general purpose or special purpose processing device to manage media.

Wireless device 1400 may also include a storage device 1404, coupled to the digital processing system, to store data and/or operating programs for the wireless device 1400. Storage device 1404 may be, for example, any type of solid-state or magnetic memory device. Wireless device 1400 may also include one or more input devices 1405, coupled to the digital processing system 1403, to accept user inputs (e.g., telephone numbers, names, addresses, media selections, etc.) Input device 1405 may be, for example, one or more of a keypad, a touchpad, a touch screen, a pointing device in combination with a display device or similar input device. Wireless device 1400 may also include a display device 1406, coupled to the digital processing system 1403, to display information such as messages, contact information, pictures, movies and/or titles or other indicators of media being selected via the input device 1405. Display device 1406 may be, for example, an LCD display device such as LCD display 504. In one embodiment, display device 1406 and input device 1405 may be the same device (e.g., a touch screen LCD). Wireless device 1400 may also include a battery 1407 to supply operating power to components of the system including digital RF transceiver 1402, digital processing system 1403, storage device 1404, input device 1405, audio transducer 1408 and display device 1406. Battery 1407 may be, for example, a rechargeable or non-rechargeable lithium or nickel metal hydride battery. Wireless device 1400 may also include audio transducers 1408, which may be one or more speakers and/or microphones for example.

In one embodiment, digital RF transceiver 1402, digital processing system 1403 and/or storage device 1404 may include one or more integrated circuits disposed on a PCB such as PCB 501 described above and included within a volume defined by or adjacent to the substantially planar element 502.

As is known in the art, antenna systems are governed by the laws of reciprocity. Therefore, it will be appreciated that any discussion above with respect to transmission properties of embodiments of the described antenna systems applies equally to reception properties. Conversely, any discussion above with respect to reception properties of embodiments of the described antenna systems applies equally to transmission properties.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An electronic device, comprising:

a display having edges; and a loop element that forms an antenna structure, wherein at least one segment of the loop element is parallel to one of the edges of the display, wherein the electronic device has first, second, and third lengths extending along first, second, and third respective orthogonal axes, and wherein the loop element substantially extends across the first and second lengths.

2. The electronic device defined in claim 1, wherein the loop element is formed around the display.

3. The electronic device defined in claim 1, further comprising a printed circuit board, wherein the display is mounted to the printed circuit board.

4. The electronic device defined in claim 3, wherein the loop element is formed around the display and the printed circuit board.

5. The electronic device defined in claim 1, wherein the loop element is at least partially filled with a solid dielectric material.

6. The electronic device defined in claim 1, wherein the loop element has a gap and wherein antenna terminals for the antenna structure are located across the gap.

7. The electronic device defined in claim 1, further comprising a backplate, wherein the backplate is located within an induction field of the loop element.

8. The electronic device defined in claim 1, wherein the electronic device comprises a cellular telephone.

9. An electronic device, comprising:

a display having edges; and a loop element that forms an antenna structure, wherein at least one segment of the loop element is parallel to one of the edges of the display, wherein the loop element has a gap, and wherein the loop element is configured to transmit digital voice signals and digital data signals.

10. The electronic device defined in claim 9, further comprising a printed circuit board, wherein the display is mounted to the printed circuit board.

11. The electronic device defined in claim 10, wherein antenna terminals for the antenna structure are located across the gap.

12. The electronic device defined in claim 11, wherein the loop element is formed around the display.

13. The electronic device defined in claim 12, wherein at least a portion of the loop element is formed from a trace on the printed circuit board.

14. Antenna structures for a cellular telephone, comprising:

a loop element having a gap;

a substantially planar element coupled with the loop element; and a display having edges, wherein at least one segment of the loop element is parallel to one of the edges of the display and the substantially planar element comprises a metal backplate of an enclosure for the cellular telephone.

15. The antenna structures defined in claim 14, wherein the loop element is formed around the display.

16. The antenna structures defined in claim 14, wherein the loop element is at least partially filled with a solid dielectric material.

17. The antenna structures defined in claim 14, wherein the substantially planar element is located within an induction field of the loop element.

18. The antenna structures defined in claim 14, wherein the substantially planar element comprises a dielectric material.

* * * * *